US005540832A

United States Patent [19]

Romino

[11] Patent Number: 5,540,832

[45] Date of Patent: Jul. 30, 1996

[54] PROCESS FOR PRODUCING SOLVATED MESOPHASE PITCH AND CARBON ARTIFACTS THEREFROM

[75] Inventor: Hugh E. Romino, Ponca City, Okla.

[73] Assignee: Conoco Inc., Ponca City, Okla.

[21] Appl. No.: 448,905

[22] Filed: May 24, 1995

Related U.S. Application Data

[62] Division of Ser. No. 336,141, Nov. 8, 1994, which is a continuation of Ser. No. 894,501, Jun. 4, 1992, abandoned.

[51] Int. Cl.[6] ..... C10C 3/02

[52] U.S. Cl. ..... 208/39; 208/22; 208/44; 208/45

[58] Field of Search ..... 208/39, 22, 45, 208/44

[56] References Cited

U.S. PATENT DOCUMENTS

| | | | |
|---|---|---|---|
| 4,005,183 | 1/1977 | Singer . | |
| 4,026,788 | 5/1977 | McHenry . | |
| 4,208,267 | 6/1980 | Diefendorf . | |
| 4,209,500 | 6/1980 | Chwastiak . | |
| 4,277,324 | 7/1981 | Greenwood . | |
| 4,277,325 | 7/1981 | Greenwood . | |
| 4,283,269 | 8/1981 | Greenwood . | |
| 4,511,625 | 4/1985 | Nazem . | |
| 4,637,906 | 1/1987 | Fukuda et al. . | |
| 4,820,401 | 4/1989 | Tsuchitani et al. . | |
| 4,985,184 | 1/1991 | Takahashi et al. . | |
| 4,990,285 | 2/1991 | Lahijani . | |
| 5,032,250 | 7/1991 | Romine et al. . | |
| 5,091,072 | 2/1992 | Tsuchitani et al. . | |
| 5,259,947 | 11/1993 | Kalback et al. | 208/44 |
| 5,437,780 | 8/1995 | Southard et al. | 208/45 |

FOREIGN PATENT DOCUMENTS

| | | |
|---|---|---|
| 0026647 | 9/1980 | European Pat. Off. . |
| 0072242 | 8/1982 | European Pat. Off. . |

*Primary Examiner*—Helane Myers

[57] ABSTRACT

This application relates to a process for making carbon artifacts from solvated mesophase pitch comprising quinoline insoluble materials. The process has a significant advantage over the art as it permits the use of otherwise unusable pitch feedstocks and the artifacts formed according to the process retain their structural integrity during carbonization. This invention also relates to the pitch formed by this process and carbon artifacts formed by this process.

3 Claims, No Drawings

PROCESS FOR PRODUCING SOLVATED MESOPHASE PITCH AND CARBON ARTIFACTS THEREFROM

BACKGROUND AND SUMMARY OF THE INVENTION

This is a division of application Ser. No. 08/336,141 filed Nov. 8, 1994; which is a continuation of Ser. No. 07/894,501 filed Jun. 4, 1992, now abandoned.

This application relates to the discovery that mesophase pitch containing quinoline insoluble materials can be converted to a solvated mesophase pitch suitable for producing carbon fibers and carbon artifacts. Solvated mesophase pitch which has a substantial quinoline insoluble content can be prepared from feedstocks which are mesophase pitch in part or in total and which contain quinoline insoluble materials. Certain advantages are achieved with solvated mesophase pitch obtained by this process including the ability to use otherwise undesirable feed stocks in the solvent extraction process to produce a solvated mesophase pitch, and the ability to produce a mesophase pitch which, when solvated, melts at a temperature suitable for spinning into fibers or forming other structures but, when dried (non-solvated), will not melt on heating to temperatures suitable for carbonization.

STATEMENT OF THE ART

It has long been known that mesophase pitch can be used to produce carbon fibers and carbon artifacts having excellent mechanical properties. The mesophase pitch used to make these items is commonly obtained by converting isotropic pitch to anisotropic (mesophase) pitch. The conversion process involves either a thermal or catalytic growth step to form large mesophase-forming molecules (mesogens) from an isotropic pitch or aromatic feed, and an isolation step to concentrate the mesogens in a mesophase pitch. The isolation of the mesophase pitch may be accomplished by settling, sparging the pitch with an inert gas to remove unwanted materials, or by extracting the unwanted materials with a solvent.

Fibers and other artifacts are formed from the resulting mesophase pitch by extrusion of molten mesophase pitch through a spinnerette or by molding techniques. The pitch is then converted to a non-meltable form, typically by oxidative stabilization. The stabilized pitch is then converted to carbon by prolonged heating at temperatures in the range of from 500° to 2000° C. in an inert or largely inert atmosphere. If higher performance properties are desired, the carbonized items may then be graphitized by additional prolonged heating at temperatures above 2000° C. in an inert or largely inert atmosphere.

There is a great amount of art on improved processes for making a preferred mesophase pitch for forming into useful artifacts. One frequent measure of mesophase pitch quality is the quinoline insolubles (QI) content. High optical anisotropy (OA) combined with low QI is taught to be preferred.

It is generally recognized that QI and OA tend to be formed together in processes that form mesogens. High OA is desired to form highly structured mesophase artifacts. High QI, on the other hand, is associated with excessively high spinning temperatures, plugging of spinning equipment and strength-limiting defects in fibers. In practice, it is often necessary to accept only moderate OA development in order to limit QI when making a mesophase pitch. This is especially true when making thermal mesogens.

As a consequence of the desire to hold the QI content of mesophase pitch low, much inventive effort has been expended in devising ways of limiting or removing quinoline insoluble materials in mesophase pitch. Also, as a result of the desire to limit the QI content of mesophase pitch, the choice of feedstocks is naturally reduced to those feedstocks having a low QI content.

One especially novel approach to making a low QI mesophase pitch was the disclosure in U.S. Pat. No. 4,208,267 that certain isotropic pitches contain mesophase-formers (mesogens) that can be isolated by extraction. The isotropic pitch feeds for extraction are selected from among low QI mesogen containing materials. The extracted pitch products contain greater than 75% OA and less than 25% QI.

In PCT Appln. 91/09290 solvent/pitch systems were disclosed that form a heavy solvent insoluble phase which contains, or which itself is, mesophase pitch in a solvated form. The solvated mesophase is disclosed as a new type of mesophase pitch consisting of solvent dissolved in a heavy aromatic pitch. Solvated mesophase is distinguished from other pitches because it is substantially anisotropic and melts at least 40° C. lower than the melting temperature of the heavy aromatic pitch when it is not solvated. Appln. 91/09290 teaches that the presence of quinoline insolubles in the solvated mesophase pitch is undesirable and that the quinoline insoluble content is controlled by preparing the solvated mesophase pitch from isotropic pitch which is also low in quinoline insoluble materials. This is consistent with the art teaching that QI components are not soluble in extracted mesophase pitch or in extraction systems and therefore would tend to clog processing equipment and form weak points in the finished product.

However, the inventor has found that mesophase pitch feedstocks having even a substantial quinoline insoluble content can be advantageously used to make solvated mesophase especially suitable for making carbon fibers and artifacts. The process of this invention has several advantages, including the ability to utilize feedstocks which are otherwise unsuitable for extraction. By the method of the invention, mesophase pitches and mesophase containing pitches, including those containing substantial amounts of QI, can be extracted to yield homogenous, spinnable solvated mesophase. Therefore, many of the mesophase pitches referred to in the art as unusable because of their high QI content can be used to make carbon artifacts by the process of this invention. Also, the invention permits spinning of QI mesogens in their solvated state at a temperature below their melting temperature when in their non-solvated state. Once stripped of solvent, the melting temperature of the mesophase pitch is dramatically increased thus permitting the artifacts to retain their structural stability during carbonization.

DETAILED DESCRIPTION OF THE INVENTION

Although the art places all QI materials into a single category, the inventor finds it is necessary to distinguish some quinoline insoluble materials found in mesophase pitch from other quinoline insoluble materials. In the present invention, foreign object QI (catalyst fines, metal filings, etc.) and certain naturally occurring QI (coke particles, carbon black particles, etc.) are considered to be detrimental to the mesophase pitch and to products made therefrom. These materials generally are referred to by the inventor as "bad QI". The naturally occurring QI which is characterized as a high melting point or no melting point organic material which is insoluble in quinoline, but soluble in the mesophase pitch itself is desirable in the mesophase pitch. This material is referred to by the inventor as "good QI", or preferably, "MSQI", for mesophase soluble quinoline insolubles. MSQI is a desirable component of mesophase pitch. Specifically, the inventor has found that the presence of certain materials in mesophase pitch, i.e. those materials found in mesophase pitch which are characterized as having a high melting temperature, or are non-melting, organic materials naturally occurring in mesophase pitch which are both insoluble in quinoline and soluble in the mesophase pitch itself are desirable components of mesophase pitch and provide advantages over a mesophase pitch which is free of these components.

In spite of the teachings of the art the inventor discovered that mesophase pitches, even those pitches which contain substantial amounts of quinoline insolubles, can successfully be used as feed stock for making solvated mesophase pitches suitable for making carbon fibers and carbon artifacts. The resulting mesophase pitch, when solvent is removed, has a high melting point, or may be unmeltable, which permits the formation of fibers and artifacts which are structurally stable when heated to effect carbonization and do not always require the application of oxidative stabilization techniques. As a result of this invention feedstocks which heretofore had been rejected because of their quinoline insolubles content or high melting temperature may now be successfully used to produce extracted solvated mesophasa pitch and carbon fibers and artifacts, and it is no longer always necessary to use oxygen to stabilize pitch prior to the carbonization process.

One aspect of the invention is the isolation by extraction of a fraction of a feed mesophase pitch which would otherwise be unsuitable for forming into mesophase artifacts. Mesogen-type fractions that are, in the non-solvated form, unmeltable can be isolated by extraction. These unmeltable fractions cannot be formed into artifacts by conventional melt processing. However, as solvated mesophase, these fractions can be melted, formed and then the solvent can be removed to make formed mesophase artifacts from otherwise unsuitable materials.

The solvated mesophase pitches of the present invention can vary in mesophase content. Normally the pitches will contain at least 40% by volume of OA in the solvated form. Preferably, artifacts are formed from solvated mesophase pitches containing at least 70% by volume OA. Solvated mesophase pitches usually contain from 5 to 40% solvent by weight based on the total weight of the solvated mesophase pitch.

When a mesophase pitch containing MSQI materials is solvated with an appropriate solvent it is meltable at temperatures below the carbonization temperature of the pitch, i.e. 400° C. or below, and can readily be spun or formed into fibers and other artifacts. After spinning or forming the pitch, the solvent solvating the mesophase pitch is driven off by such means as applying moderate heat while the formed pitch is subjected to a vacuum or the atmosphere is purged with an inert (non-oxidative) gas. The non-solvated pitch articles may then be converted to carbon by subjecting the articles to temperatures for a period of time and under conditions suitable for carbonization.

Optionally, the process of oxidative thermosetting may be applied prior to the carbonization of the pitch of the present invention. Because of the high-temperature stability of articles formed with the pitch of the invention the process step of oxidative thermosetting is often optional. When oxidative thermosetting is practiced it can be done at surprisingly high temperatures, well above the spinning temperature, on account of the high melting temperature of the solvent-free form of the pitch of the present invention. The oxygen uptake required to make the pitch unmeltable is correspondingly reduced.

In a concise statement, the present invention comprises solvated mesophase pitch wherein the non-solvent portion of the pitch is greater than 50% quinoline insoluble and the solvated pitch can be formed into artifacts, desolvated, and heated above the artifact-forming temperature without loss of artifact structure to melting.

During the carbonization process the articles formed from the mesophase pitch containing MSQI can remain structurally stable, as the non-solvated MSQI containing pitch can remain solid or unmelted at temperatures above the carbonization temperature of the pitch. Generally, carbonization occurs at a useful rate above 450° and especially above 500° C.

Often a carbonized artifact is the desired product. However, if higher performance is demanded of the formed artifacts, graphitization may then be carried out by heating the carbonized materials to even higher temperatures for a prolonged period of time.

The process of the invention comprises the steps of:

(a) forming a solvent-mesophase pitch mixture from a mesophase or mesophase-containing pitch having a MSQI content, and a solvent or combination of solvents suitable for solvating the mesophase pitch;

(b) heating the solvent-mesophase pitch mixture to a predetermined temperature while mixing for a time sufficient to form solvated mesophase pitch in a fluid state;

(c) phase separating the solvent-pitch mixture to obtain a solvent (extract) phase and a solvated mesophase pitch phase;

(d) recovering the solvated mesophase pitch phase;

(e) forming artifacts of a desired shape from the solvated mesophase pitch by shaping molten solvated mesophase pitch to the desired shape;

(f) de-solvating the mesophase pitch for a sufficient period of time by heating the pitch to a temperature below its solvated melting point and optionally, conducting the desolvating process under reduced pressure and/or sparging with inert gas to effect a partial or complete drying of the pitch artifacts;

(g) carbonizing the pitch artifacts by heating the artifacts to a temperature for a period of time and under conditions suitable for carbonization of the de-solvated mesophase pitch artifacts; and (h) optionally, heating the carbonized mesophase pitch artifacts to a temperature and under conditions suitable for graphitization of the carbonized pitch artifacts.

Optionally, one can apply oxidative stabilization in conjunction with step (f), while volatiles are being removed, or as an alternative option, at the conclusion of step (f) after volatiles have been removed.

Suitable mesophase pitch starting materials are those mesophase pitches having an MSQI content up to 100 wt. % of the mesophase pitch. Such pitches include naphthalene derived mesophase pitch commercially available under the tradenames ARA 22 and ARA 24 from Mitsubishi Gas Chemical Company. Other suitable pitches include mesophase pitches such as described in U.S. Pat. Nos. 4,005,183 and 4,209,500, for example.

Although the process of this invention broadens the range of mesophase pitches which may be used to make carbon fibers and artifacts some pitches may still not be suitable for this application. For instance, unrefined mesophase pitch derived from coal tar pitch contains very large quantities of insoluble carbonaceous soot and soot-like materials which would clog spinnerettes and reduce the quality of carbon fibers and articles formed therefrom. Other unsuitable pitches include unrefined pitches derived from ethylene pyrolysis tars (pyro tars) and unrefined pitches derived from petroleum asphalts which contain large quantities of asphaltic materials. The bad QI content of the mesophase pitch must still be kept to a minimum in this invention.

Suitable solvents for use in forming the solvent-pitch mixture are one or more highly aromatic hydrocarbons wherein 40% or more (40–100%) of the carbons in the solvent are aromatic carbons. The solvents generally comprise one, two, and three ring aromatic solvents which may optionally have short alkyl sidechains of from $C_1$–$C_6$ and hydroaromatic solvents which may optionally have short alkyl sidechains of from $C_1$–$C_6$. Solvent mixtures can contain some paraffinic components, such as heptane, to adjust solubility. Specific solvents which can be used in this invention include one or more of the solvents selected from the group consisting of tetralin, xylene, toluene, naphthalene, anthracene, and 9,10-dihydrophenanthrene.

The solvent pitch mixture is loaded into extraction equipment which for batch processing would be a suitable sealable container able to withstand the temperature and pressure generated by heating the contents to a range of 180°–400° C. for up to several hours. It is believed the pressure within the closed vessel helps to solvate the pitch. Also, the closed container prevents the solvent from escaping so pressure is essential to the process of the invention. An autoclave was used to prepare laboratory sized amounts of mesophase pitch for the Examples herein. It is envisioned that suitably sized and configured extraction equipment can be used to produce commercial quantities of pitch in either batch amounts or by a continuous process. It is also envisioned that the solvent separation can be accomplished by supercritical extraction wherein one or more solvent components is at supercritical conditions during the separation.

The solvent pitch mixture must be agitated or mixed during the heating process. Extraction equipment must therefore be equipped with stirring paddles, pump around loops, or other means for agitating and mixing together the pitch and solvent. In the case of a batch process, the container could be fitted with mixing paddles or blades as are well known in the art. In the case of continuous processing of the mesophase pitch, an in-line mixing device could provide adequate mixing.

The temperature to which the pitch and solvent mixture is heated and extraction is conducted is in the range of 180°–400° C. Preferably, the temperature is in the range of from 220°–350° C.

The pressure under which the heating is carried out is at or above the vapor pressure of the solvent or solvent mixture used in the extraction. Generally, this pressure would be the range of atmospheric to 5000 pounds per square inch gauge (psig), depending on the vapor pressure of the solvent. It is recognized that the vapor pressure of certain solvents suitable for use in this process may in fact be lower than atmospheric pressure. Although no experiments were conducted with solvents having a vapor pressure below atmospheric pressure it is believed that they would adequately solvate the pitch.

The amount of time required for mixing and phase separation ranges from about five minutes to several hours or longer. No specific amount of time is recited as the amount of time required for these steps will vary depending on the pitch, solvent, mixing, and the processing temperatures. As a general rule mixing should continue until the pitch is adequately solvated, and standing or separating should continue as long as necessary to obtain a solvent phase and a solvated pitch phase.

Separation of the solvent phase and the solvated pitch phase can be accomplished simply by allowing the mixture to stand without agitation. While this may be an adequate separation technique for batch processing techniques, it is envisioned that mechanical separators, such as centrifugal separators, may also be used to effect separation. In continuous process set-ups, separation may be accomplished in the line, or by passing the solvent-pitch mixture into a mechanical separator, or by passing the mix into suitable container or settling tank in which separation can occur.

Once the mixing of the extracted solvent-pitch mixture stops, the contents of the sealed container will phase separate into an upper solvent phase and a lower pitch phase. If permitted to cool sufficiently, the pitch phase will thicken and eventually harden. The thickening and solidifying temperatures can be determined by occasional movement of the paddles or other stirring means within the vessel. The pitch can be readily recovered after cooling to a solid. However, it is envisioned that the pitch could be recovered after phase separation has occurred, but while the pitch is still in a liquid form. It is further envisioned that if removed from the container while molten, the pitch could be formed into fibers and other artifacts directly, thus eliminating the need to remelt the pitch.

Melting behavior of the pitches described in this invention were observed while heating the pitches on a microscope hot stage under inert atmosphere at a heating rate of 5° C. per minute. Pitches were crushed to particle sizes from 10–200 microns before testing. Softening was said to occur at the first rounding of angular features of the pitch particles. Melting occurred when the first observable flow of the softened pitch was seen.

The invention will be further illustrated in the following examples.

EXAMPLES

Example 1

A batch of mesophase pitch was prepared from mid-continent refinery decant oil residue. The residue was an 850° F. (454° C.) and higher fraction which was found through NMR testing to be 92% carbon and 6.5% hydrogen. The residue was converted to mesophase pitch by heat soaking the oil residue at 386° C. for 28 hours while nitrogen was sparged through the oil residue at a rate of 0.08 standard cubic feet per hour per pound of oil residue.

After heat soaking, the residue was tested under plane polarized light and it was observed that the material had been converted to mesophase pitch. Further testing revealed the mesophase pitch melted at 329° C. and that the pitch yield was 15 wt. % of the starting residue. A portion of the mesophase pitch was tested for QI content by contacting 1 part of pitch with 20 parts of quinoline for a period of 2 hours at 70° C. The QI content was determined to be 81.1 wt. % of the mesophase pitch.

The mesophase pitch obtained by the process above was then combined with an equal weight amount of tetralin in an autoclave. The autoclave was then purged with nitrogen, evacuated and sealed. The contents of the autoclave were heated to 326° C. over 110 minutes while being stirred. The maximum pressure of the autoclave reached 120 psig.

Stirring was continued while the contents were allowed to cool to 294° C. over 30 minutes. Cooling of the contents was allowed to continue without stirring. Occasional movement of the stirrer revealed the contents thickened at about 290° C. and solidified at about 245° C.

On opening the cooled autoclave the contents were found to have separated into an upper liquid solvent extract phase, and a lower solid pitch phase. Plane polarized light microscopy of the solid pitch phase revealed that the material was a solvated mesophase pitch with 100% anisotropy. Analysis showed the pitch yield was 79% of the mesophase pitch charged in the autoclave.

The pitch was vacuum dried for 2 hours at 250° C. Analysis revealed that 21.4% volatile solvent had been removed from the pitch through this drying step. To determine the melting point of the dried pitch it was placed on a microscope hot stage under a nitrogen purge and heated at the rate of 5° C. per minute to 650° C. Although 650° C. is over 400° C. higher than the solidification point of the solvated mesophase pitch, the dried pitch showed no signs of melting.

Example 2

In this example an already prepared mesophase pitch was used which is available under the trade name ARA22 from Mitsubishi Gas Chemical Company, Inc., Tokyo, Japan. ARA 22 is a 100% mesophase pitch having a 220° C. softening temperature. ARA 22 is reported to be obtained by the HF—$BF_3$ catalyzed polymerization of naphthalene. A sample of ARA 22 was tested for QI content by the method described in Example 1 and found to be 55.7% QI.

7 parts of ARA 22 mesophase pitch were mixed in an autoclave with 2 parts tetralin solvent. The autoclave was purged with nitrogen, evacuated and then sealed. The contents of the autoclave were heated to 252° C. over 90 minutes while being stirred. Stirring was continued for 65 minutes while the contents of the autoclave were maintained at about 250° to 252° C. The maximum pressure of the autoclave reached 20 psig.

Stirring was discontinued and the contents were allowed to cool at the rate of about 1.5° C. per minute until reaching ambient temperature. Occasional movement of the stirrer revealed the contents thickened at about 177° C. and solidified at about 135° C. On opening the autoclave, the contents were found to be in two phases; a upper fluid (solvent) extract phase, and a lower solid pitch phase.

The pitch layer was found to be 100% anisotropic solvated mesophase pitch and the pitch yield was determined to be 81% based on the original weight of the ARA 22 mesophase. On vacuum drying followed by vacuum fusion at 360° C., 21.1% volatiles was removed from the pitch. The fused pitch softened at 309° C., melted at 320° C. and was 100% anisotropic. The softening point of the fused pitch was found to be higher than the softening point of the starting material mesophase pitch and much higher than the solidification temperature of the solvated mesophase pitch.

Example 3

7 parts of the ARA 22 mesophase pitch starting material described in Example 2 was mixed with 2 parts of xylene solvent. The pitch and solvent were loaded in a nitrogen purged and evacuated autoclave, which was subsequently sealed. The contents of the autoclave were stirred while being heated to 253° C., then stirred for 30 minutes at about 250° C., and subsequently cooled following the procedure in Example 2. Thickening of the contents was noted at about 173° C. and solidification at about 145° C.

On opening the autoclave the contents were separated into an upper extract (solvent) phase and a lower solid pitch phase. The pitch was analyzed under plane polarized light and found to comprise 99% anisotropic solvated mesophase. The pitch yield was determined to be 95%.

The pitch was vacuum dried and then vacuum fused at 360° C., thereby removing 180% volatiles The fused pitch was found to soften at 300° C., and to melt at 306° C. The fused pitch was determined to be 100% anisotropic mesophase pitch.

Example 4

1 part of ARA 22 mesophase pitch starting material and 1 part of tetralin solvent were mixed together and placed in an autoclave. The autoclave was nitrogen purged, evacuated, and sealed. The contents of the autoclave were stirred while heat was applied over two hours to bring their temperature to 315° C. Stirring was continued for an additional 30 minutes while the temperature was held at 315° C. The mixture was slowly cooled with only occasional movement of the stirrer to test for thickening of the pitch. Thickening was noted at about 217° C. and solidification at about 185° C. On opening the autoclave, it was observed that the contents had separated into an upper liquid extract (solvent) phase and a lower solid pitch phase. The pitch tested as 100% anisotropic solvated mesophase and the yield was calculated to be 55%.

The pitch was dried for 1.5 hours at 250° C. in a vacuum, wherein 17% volatile solvent was removed. On subjecting the dried pitch to heating on a hot stage of a microscope, with a 5° C. increase in temperature per minute up to 650° C., no melting was observed.

Some of the dried pitch was further treated by being heated in a vacuum at 360° C. for 30 minutes to cause fusing of the pitch. This additional treatment resulted in removal of 2.2% additional volatiles, comprising solvent and a small amount of volatile oils. Total volatiles removal for going from a solvated mesophase to a fused mesophase pitch was 19.2%. The fused mesophase pitch tested as being comprised of 95.2% QI. By comparison, a sample of the solvated mesophase product before drying or fusing tested as comprising 76.0% QI.

Example 5

Preparation of Feedstock for Examples 6 & 7

An isotropic petroleum pitch 850°+F. residue was obtained from a mid-continent refinery decant oil. The residue was heat soaked for 6.9 hours at 748° F. and then partly de-oiled by vacuum distillation. The resulting heat soaked pitch was determined to have an insolubles content of 20.0 wt % by combining a sample of the heat soaked pitch in ambient temperature tetrahydrofuran at a weight ratio of solvent to pitch of 20:1.

The heat soaked pitch was combined with xylene in a ratio of 1 gm pitch to 8 ml solvent. The mixture was loaded into an autoclave which was then evacuated and sealed. While being stirred, heat was applied to the mixture to bring it to a temperature of 235° C., at which temperature, the pressure within the autoclave was measured at about 95 psig. The mixture was maintained at a temperature of 235° C. and stirring was continued for 1 hour, then the mixture was allowed to settle at that temperature for 25 minutes. On cooling, a dense cake of solvated mesophase pitch was recovered from the bottom of the autoclave. The yield of solid product was calculated to be about 30%.

The solvated mesophase pitch was dried and then fused under vacuum at 360° C. to remove 17% volatiles. The fused pitch was determined to be 100% anisotropic and comprise 22.1% QI. The mesophase pitch prepared in this manner was used in Examples 6 and 7.

Example 6 (Comparative Example)

The fused mesophase pitch as prepared in Example 5 was mixed with tetralin in a weight ratio of 7 parts pitch to 2 parts solvent. The mixture was loaded into an autoclave which was then evacuated and sealed. While being stirred, heat was applied to the mixture to bring it to a temperature of 250° C. The mixture was maintained at a temperature of 250° C. and stirring was continued for 30 minutes. The maximum pressure within the autoclave was measured at about 20 psig. The contents of the autoclave were allowed to cool and it was noted that the pitch thickened near 159° C. and solidified near 125° C. Upon opening the autoclave the contents were in the form of a single phase of solid pitch, the yield of which was calculated at 129%. Polarized light microscopy revealed the pitch was comprised of 90% anisotropic solvated mesophase.

This comparative example shows that certain extracted mesophase pitches will resolvate rather than extract when combined with an amount of a solvent up to the amount of solvent which is soluble in the pitch. In Example 7, the same pitch was combined with an excess amount of solvent (i.e. an amount of solvent greater than that which is soluble in the pitch) which acts to solvate and extract the materials necessary in order to make a mesophase pitch according to the process of the invention.

Example 7

The same fused extracted mesophase pitch described in Example 5 was combined with tetralin in a weight ratio of 1 part pitch to 1 part solvent. The mixture was stirred 30 minutes at 307° C. and then slowly cooled. Thickening was noted at 210° C. and the pitch solidified near 175° C. The cooled autoclave contained a top tar-like extract phase and solid pitch bottom phase. The bottom mesophase portion of the pitch tested 100% anisotropic and was obtained in 90% yield. Vacuum drying followed by vacuum fusion at 360° C. removed 28.4% volatiles from the pitch. The fused mesophase partly softens at 373° C. and partly melts at 405° C. when heated at 5° C. per minute under nitrogen. QI of the fused pitch tested 85.6%.

Example 8 (Comparative)

Petroleum needle coke was selected as the mesophase feedstock for this example. As produced or "green" needle coke is a 100% anisotropic mesophase produced by thermal treatment of graphitizable carbonaceous feedstocks. Coking involves heat soaking the feeds to form mesophase and continuing the heat soak until the mesophase is completely unmeltable. The coke for this example tested 15.3% volatile matter when vigorously heated.

Green petroleum needle coke was combined with tetralin in a 7 to 2 weight ratio. Following the procedure of Example 5, the mix was stirred at 320° C. for 30 minutes. A pressure of 80 psig developed on account of the heating. On slow cooling the mixture became viscous at 156° C. but never became solid at or above room temperature. The cooled product consisted of a fluid tar phase and coke particles. While the solvent extracted some components from the coke, there was no evidence that the coke particles solvated. The particles remained angular indicating no softening at the process conditions.

This example shows that mesophase can be processed until it is sufficiently hard or high molecular weight so that it is no longer a suitable feed for making low melting solvated mesophase pitches.

Example 9

Mesophase pitch was obtained from Maruzen Petrochemical Company, Ltd., Japan, which was reportedly produced from coal derivative feeds. The pitch was 100% anisotropic and its quinoline insoluble content was determined to be 0.05%

The pitch was combined with tetralin in a weight ratio of 7 parts pitch to 2 parts solvent. The mixture was heated and stirred in an autoclave at 250°–252° C. for 30 minutes and then it was gradually cooled. All of the product was found to be solid, but separated into an upper isotropic phase and a lower anisotropic phase. The anisotropic phase was found to be 100% optically active (anisotropic) solvated mesophase, the yield of which was 32%. The thickening and solidification temperatures of this pitch were not observed because the level of pitch in the autoclave was not high enough to cover the stirrer blade. However, the solvated mesophase of this pitch was clearly fluid at 252° C., the process temperature of the solvation step in this Example. This is well below the 290° C. softening temperature of the Maruzen mesophase pitch.

The foregoing exemplification and description are provided to more fully explain the invention and provide information to those skilled in the art on how to carry it out. However, it is to be understood that such is not to function as limitation on the invention as described and claimed in the entirety of this application.

What is claimed is:

1. A solvated mesophase pitch having a substantial quinoline insoluble-mesophase soluble content produced by the process comprising:

(a) forming a solvent-mesophase pitch mixture by contacting a mesophase pitch or mesophase containing pitch comprising mesophase soluble-quinoline insoluble materials and a solvent suitable for solvating the mesophase pitch;

(b) heating and mixing the solvent-mesophase pitch mixture to a pre-selected temperature for a length of time and under conditions suitable for forming solvated mesophase pitch in a fluid state;

(c) phase separating the solvent-pitch mixture to obtain a solvent phase and a solvated mesophase pitch phase, wherein the non-solvent portion of said solvated mesophase pitch phase is greater than 50% quinoline insoluble;

(d) recovering the solvated mesophase pitch phase.

2. A solvated mesophase pitch having a mesophase soluble-quinoline insolubles content of at least 50 wt. % of the unsolvated mesophase pitch, wherein the melting point temperature of the solvated mesophase pitch is at least 40° C. lower than that of the unsolvated mesophase pitch where both forms are meltable, and where the unsolvated mesophase is partially or completely unmeltable, and the solvated mesophase pitch is meltable.

3. Solvated mesophase pitch wherein the non-solvent portion of the pitch is greater than 50% quinoline insoluble and the solvated pitch can be formed into artifacts, desolvated, and heated above the artifact-forming temperature without loss of artifact structure to melting.

* * * * *

UNITED STATES PATENT AND TRADEMARK OFFICE

CERTIFICATE OF CORRECTION

PATENT NO. : 5,540,832
DATED : July 30, 1996
INVENTOR(S) : Hugh E. Romaine

It is certified that error appears in the above-indentified patent and that said Letters Patent is hereby corrected as shown below:

On the title page: Item 75 &19 the inventor name "Romino", both occurrences should be --Romine--.

Column 8, line 12, "180%" should be --18.0%--; and after the word "volatiles" the --.-- was omitted.

Signed and Sealed this

Twelfth Day of November, 1996

*Attest:*

BRUCE LEHMAN

*Attesting Officer*

*Commissioner of Patents and Trademarks*